US006931982B1

(12) United States Patent
Zajac, Jr. et al.

(10) Patent No.: US 6,931,982 B1
(45) Date of Patent: Aug. 23, 2005

(54) LINEAR ACTUATOR

(76) Inventors: Theodore S. Zajac, Jr., 335 Vassar Ave., Elyria, OH (US) 44035; Brian K. Thompson, 2280 W. River Rd. North, Elyria, OH (US) 44035

( * ) Notice: Subject to any disclaimer, the term of this patent is extended or adjusted under 35 U.S.C. 154(b) by 83 days.

(21) Appl. No.: 10/297,703

(22) PCT Filed: Jul. 12, 2000

(86) PCT No.: PCT/US00/40357

§ 371 (c)(1),
(2), (4) Date: Apr. 7, 2003

(87) PCT Pub. No.: WO01/94796

PCT Pub. Date: Dec. 13, 2001

Related U.S. Application Data

(60) Provisional application No. 60/209,479, filed on Jun. 5, 2000.

(51) Int. Cl.[7] ..... F15B 15/14

(52) U.S. Cl. ..... 92/5 R; 92/165 PR

(58) Field of Search ..... 92/5 R, 165 R, 92/165 PR, 166

(56) References Cited

U.S. PATENT DOCUMENTS 2,956,549 A * 10/1960 Malpass ..... 92/165 PR
4,406,215 A * 9/1983 Lacasse ..... 92/165 PR
4,731,886 A * 3/1988 Heinrich et al. ..... 92/151
5,351,599 A * 10/1994 Stoll ..... 92/165 PR
5,568,760 A * 10/1996 Volzer ..... 95/5 R
5,761,985 A * 6/1998 Stoll ..... 92/165 PR
5,974,948 A * 11/1999 Thompson et al. ..... 92/165 PR
6,170,806 B1 * 1/2001 Mintgen et al. ..... 92/88

* cited by examiner

*Primary Examiner*—Edward K. Look
*Assistant Examiner*—Igor Kershteyn
(74) *Attorney, Agent, or Firm*—Eschweiler & Associates LLC

(57) ABSTRACT

A rotation-preventing slide is provided for a linear actuator which includes a housing which defines an internal bore and a piston-rod assembly which linearly moves within the internal bore in response to fluid pressure. The rotation-preventing slide is connected to and moves with the piston-rod assembly within a guide defined by the housing and has a geometry (e.g., polygonal, rectangular, square) which prevents rotation of the piston-rod assembly. The slide may include a bearing block and an attachment member which extends through an opening in the bearing block and which is removably attached to the piston-rod assembly whereby the slide's bearing surface (e.g., the bearing block) may be easily replaced. The guide may be a guide slot position parallel to, but axially offset from, the internal bore.

25 Claims, 2 Drawing Sheets

LINEAR ACTUATOR

CROSS REFERENCE TO RELATED APPLICATIONS

The present application claims to priority of provisional patent application Ser. No. 60/209,479 filed on Jun. 5, 2000 incorporated by reference.

FIELD OF THE INVENTION

This invention relates generally as indicated to a linear actuator and, more particularly, to a linear actuator having a slide for preventing rotation of the piston-rod assembly relative to the housing.

BACKGROUND OF THE INVENTION

In many manufacturing processes, individual sheet metal parts are fabricated with locating holes. Specifically, locating pins extend through these holes to hold the sheet metal parts in position relative to each other and to the overall assembly during the welding process. Thus, accurate positioning of the locating pins is necessary to assure consistent assembly.

In some situations, stationary locating pins may be fixed to the frame of the relevant manufacturing equipment. However, in many manufacturing situations, the locating pins must be retracted from the completed sheet metal assembly so that it can progress to the next station. In these latter situations, the locating pin(s) are commonly mounted on a linear actuator.

A linear actuator typically comprises a housing which defines an internal bore and a piston-rod assembly which moves within the internal bore in response to fluid pressure. One end of the rod is attached to the piston. The other leading end of the rod (which extends beyond the housing) includes pilot holes, flats and/or threaded passages for securing a locating pin thereto.

During the locating and/or welding process, it is important that the piston-rod assembly not rotate relative to the housing. This non-rotation is crucial to insuring that the working position of the locating pin is reliable and repeatable. Rotational issues are magnified when it is necessary for a locating pin to be attached to an actuator with an offset in order to allow the pin to fit around some other part of the equipment during sheet metal working operations.

One technique traditionally used to prevent rotation of a piston-rod assembly in a linear actuator is provide the rod and corresponding bearing surface (of the internal bore) with a rotation-preventing cross-sectional geometry.

For example, the rod/bearing surface can be fabricated having a square cross-sectional geometry. However, such polygonal arrangements are difficult to fabricate in that consistently matching a square bearing to a square shaft in a high production environment is technically challenging. Additionally, even if fabrication issues are ignored, such polygonal arrangements tend to present wear problems. Specifically, whenever torque is applied to the shaft (as from an offset locating pin) the four corners of the shaft will continuously contact the bearing surface thereby making these minimal areas of the rod extremely susceptible to wear. Significantly, replacement of the worn parts usually requires disassembly of the housing components, disassembly of the piston-rod assembly, and replacement of the entire rod.

Another rotation-preventing cross-sectional geometry which is commonly used is a round shaft with a circumference-interrupting flat and a circular bearing surface with a corresponding flat. This shaft design is much easier to manufacture than the square shaft because the flat-grinding process is controllable, even in a high production environment. However, these shafts also tend to wear rapidly because there is only a single point of contact between the flat and the bearing when a torque is applied to the shaft. Again, significantly, replacement of the worn parts usually requires disassembly of the housing components, disassembly of the piston-rod assembly, and replacement of the entire rod.

Instead of the rod, the piston of the piston-rod assembly, and the corresponding piston chamber, may be made with a rotation-preventing shape. For example, the piston having an oval, rather than circular cross-sectional shape may be used thereby geometrically preventing rotation of the piston within its chamber. Again, significantly, replacement of the worn parts usually requires disassembly of the housing components, disassembly of the piston-rod assembly, and replacement of the entire piston.

Accordingly, the inventors appreciated that a need remains for a rotation-preventing device which does not require non-circular piston-rod components, which does not increase the axial length of the actuator, and/or which has bearing surfaces which may be easily accessed, inspected repaired, and/or replaced.

SUMMARY OF THE INVENTION

The present invention provides a rotation-preventing slide for a linear actuator which prevents rotation of the piston-rod assembly relative to the housing. The rotation-preventing slide allows the use of standard circular piston-rod components and does not include any axial extensions. Furthermore, the rotation-preventing slide, and particularly its bearing surface, may be easily accessed, inspected, repaired and/or replaced without disassembly of the piston-rod assembly, without disassembly of the housing assembly, and/or without replacement of the piston-rod components.

More particularly, the present invention provides a slide which is connected to and moves with the piston-rod assembly within a guide defined by the housing. The slide and guide each have a complimentary rotation-preventing geometry thereby preventing rotation of the piston-rod assembly. The rotation-preventing geometry may be polygonal, or more particularly rectangular, or even more particularly square. Because the rotation-preventing device of the present invention does not depend upon the cross-sectional geometry of the piston-rod assembly, the piston-rod assembly may comprises a rod and a piston having circular cross-sections.

The guide may be a guide slot positioned parallel to, but axially offset from, the internal bore. If the housing comprises a rod end cap, a cylindrical wall, and a rear end cap, the guide slot may be formed in the rod end cap. In any event, because of the axial positioning of the slide, axial extensions of the piston-rod assembly are not necessary.

The slide may comprise a bearing block and an attachment member which extends through an opening in the bearing block. The attachment member may have a lower threaded portion which is screwed into a radial threaded opening in the piston-rod assembly, or more particularly, the rod.

In this manner, the slide's bearing surface (the bearing block) may be replaced by simply unscrewing the attachment member, removing the used bearing block from the guide, placing the new bearing block in the guide, and screwing the attachment member back into the piston-rod assembly. The bearing surface (i.e., the bearing block) of the rotation-preventing slide is thus easily replaceable.

If the housing of the linear actuator includes an open-topped receptacle which is covered by a cover, the guide may constitutes a bottom extension of the receptacle. In this manner, an upper portion the attachment member would be positioned within the receptacle and easily accessible by removing the cover. If the linear actuator is to include a sensor assembly to generate signals when the piston-rod assembly is at certain positions, the rotation-preventing slide may incorporates the certain components of the sensing assembly.

These and other features of the invention are fully described and particularly pointed out in the claims. The following descriptive annexed drawings set forth in detail a certain illustrative embodiment of the invention, this embodiment being indicative of but one of the various ways in which the principles of the invention may be employed.

DRAWINGS

DETAILED DESCRIPTION

Figure 1:
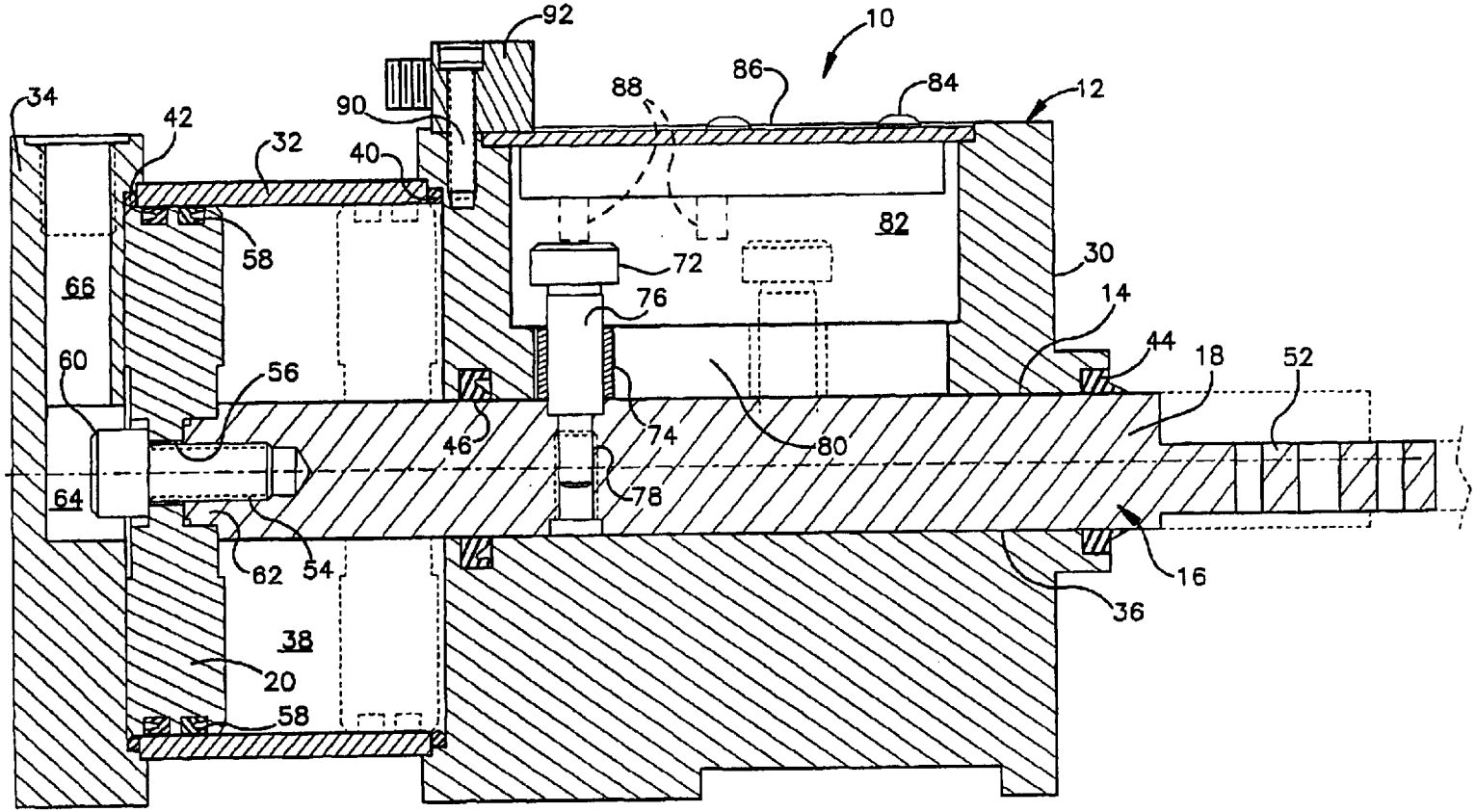
FIG. 1 is a cross-sectional view of a linear actuator according to the present invention.
Figure 2:
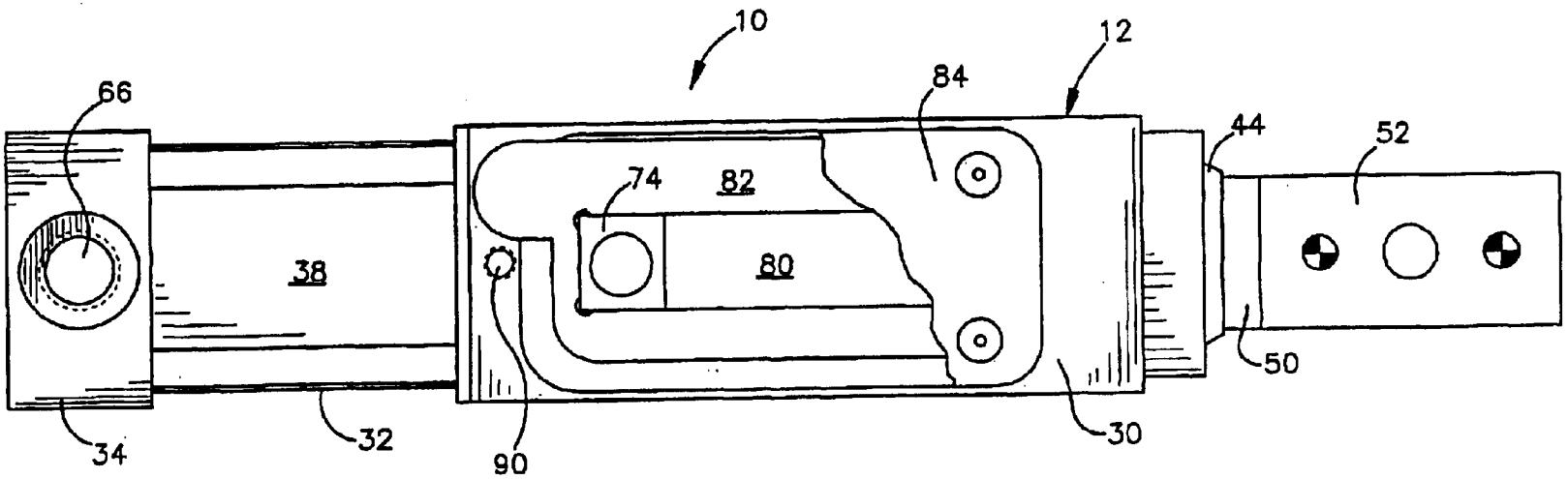
FIG. 2 is a top view of the linear actuator with its housing cover partially removed and certain components of its anti-rotation device omitted.

Referring now to the drawings in detail, a linear actuator 10 according to the present invention is shown. The linear actuator 10 comprises a housing 12 which defines an internal bore 14 and a piston-rod assembly 16 which includes a rod 18 and a piston 20. Fluid supply lines (not shown) supply pressurized fluid to the actuator to linearly move the piston-rod assembly 14 within the Internal bore 14 between the retracted position shown in FIG. 1 and the extended position shown in phantom in FIG. 1.

The illustrated housing 12 comprises a rod end cap 30, a cylindrical wall 32, and a rear end cap 34. The rod end cap 30 includes a centrally located cylindrical passage 36 which is the leading part of the internal bore 14 and which is shaped, sized, and machined to allow smooth linear sliding of the rod 18 and thus functions as a bearing surface. The cylindrical wall 32, together with the facing ends of the caps 20 and 24, define a piston chamber 28 which is the rear part of the internal bore 14 and which is shaped, sized and machined to allow smooth linear sliding of the piston 20.

Seals may be employed between the housing components namely, for example, O-ring seals 40 and 42 may be positioned in annular shoulders in the caps 30 and 34 to seal the cylinder wall 32 to the caps. Also, a scraper seal 44 may be positioned within an annular groove in the rod end cap 20 surrounding the outlet of the passage 36 and/or a U-cap seal 46 may be positioned within an annular recess in the rod end cap 16.

The rod 18 of the piston-rod assembly 16 comprises a primary cylindrical portion 50 which slides within the bore 14 and a leading extension portion 52. The leading end of the portion 50 is attached to the extension portion 52 and its rear end includes a stepped contour and a central axial threaded opening 54. The extension portion 52 includes pilot holes and various flats and threaded passages for securing a locating pin thereto.

The piston 20 of the piston-rod assembly 16 is generally annular and includes a threaded central opening 56 surrounded by annular stepped ridges. The piston 20 carries a pair of U-cap seals 58 in circumferential grooves. The seals 58 ride against the interior surface of the cylindrical wall 32 so that fluid pressure applied to one side of the piston 20 causes the piston-rod assembly 16 to move in one direction or the other without leakage between the piston 20 and the internal surface of the cylinder 32.

The rod 18 and the piston 20 are connected together by a threaded attachment member 60 which extends through the openings 54 and 56. An O-ring 62 may be used to seal the attachment between the rod 18 and the piston 20. An axially central opening 64 in the rear end cap 34 accommodates the head of the attachment member 50. A radially extending channel 64 with a threaded inlet communicates with the opening 66 for connection to a fluid supply line.

The linear actuator 10 according to the present invention includes a rotation-preventing slide 72 for preventing rotation of the piston-rod assembly 16, and particularly the rod 18, during operation. The slide 72 is attached to the piston-rod assembly 16 for movement therewith. In the illustrated embodiment, the slide 72 comprises a cubical bearing block 74 and an attachment member 76. The attachment member 76 extends through a circular core in the bearing block 74 and its lower threaded portion is attached to the rod 18. Specifically, the lower portion is screwed into a radial threaded opening 78 in the rod 18 thereby attaching the bearing block 74 to the piston-rod assembly 16.

During retraction/extension of the piston-rod assembly 16, the slide 72 travels within a guide 80. In the illustrated embodiment, the guide slot 80 is formed in the rod end cap 30 and has a square cross-section corresponding to the geometry of the bearing block 74. In any event, the guide 80 ensures that the slide 72 moves only linearly in the axial direction of the piston-rod assembly 16. By preventing transverse movement of the slide 72, rotation of the piston-rod assembly 16 is also prevented.

In the illustrated embodiment, the rod end cap 30 defines an open-topped receptacle 82 which may be concealed by a cover 84. The guide 80 constitutes a bottom extension of this receptacle 82 whereby an upper portion the attachment member 76 is positioned there within. Thus, access to the rotation-preventing slide 72 may be easily gained by simply removing the cover 84 without disassembly of the housing components 30, 32 and 34. Additionally, to inspect, repair and/or replace the bearing block 74, one must simply unscrew the attachment member 76 and withdraw the bearing block 74 from the guide 80 whereby disassembly of the rod 18 and piston 20 from each other and/or the housing 12 is not necessary. Initial assembly, or re-assembly, of the rotation-preventing slide 72 may be performed in the reverse manner. In this regard, it is noted that the rod 18 may include a plurality of axially aligned threaded openings 78 (such as four openings arranged 90° apart) for ease in initial assembly.

The receptacle 84 may also be used to house a sensing assembly 86 for the actuator 10. Such a sensing assembly 86 may be desirable in certain applications to generate a signal when the piston-rod assembly 16 reaches either of its extreme positions and/or certain positions therebetween. The illustrated embodiment of the invention allows the rotation-preventing slide 72, and particularly the attachment member 76, to incorporate certain components of the sensing assembly 86 thereby making their inspection, repair, and/or replacement also convenient. For example, satellite sensors 88 may be suspended within the receptacle 84 to sense the position of the attachment member 76, and therefore the piston-rod assembly 16. An opening 90 in the top surface of the rod end cap 30 may be used for attachment of a housing 92 of the for data connection.

Accordingly, one may now appreciate that the present invention provides a rotation-preventing slide which prevents rotation of the piston-rod assembly relative to the housing. The rotation-preventing slide may be used with standard circular piston-rod components and does not include any axial extensions. Furthermore, the bearing surface of the rotation-preventing slide may be easily accessed, repaired, and/or replaced without disassembly of the piston-rod assembly and/or the housing assembly.

Although the invention has been shown and described with respect to a certain embodiment, it is obvious that equivalent and obvious alterations and modifications will occur to others skilled in the art upon the reading and understanding of this specification. The present invention includes all such alterations and modifications and is limited only by the scope of the following claims.

What is claimed is:

1. A linear actuator comprising:

a housing which defines an internal bore having a rear part forming a piston chamber, wherein the housing-comprises a rod end cap, a cylindrical wall, and a rear end cap;

a piston-rod assembly which linearly moves within the internal bore in response to fluid pressure and which includes a piston positioned within the piston chamber and a rod connected to the piston;

a guide defined by the housing, wherein the guide is a guide slot parallel with a portion of the internal bore which defines a bearing surface for the piston-rod assembly, and wherein the guide slot is formed in the rod end cap;

a bearing block, wherein the bearing block extends radially from the rod into the guide, therein defining a bearing surface, wherein the bearing block has a geometry to prevent rotation of the piston-rod assembly, and wherein the bearing block and the guide are separate from the piston chamber; and an attachment member that extends through an opening in the bearing block, therein coupling the bearing block to the rod, wherein the bearing block is operable to move with the piston-rod assembly.

2. A linear actuator as set forth in claim 1, wherein the rod has a circular cross-section and the piston has a circular cross-section.

3. A linear actuator as set forth in claim 1, wherein the rotation-preventing geometry is a geometry having a polygonal cross-section.

4. A linear actuator as set forth in claim 3, wherein the rotation-preventing geometry is a geometry having a rectangular cross-section.

5. A linear actuator as set forth in claim 4, wherein the rotation-preventing geometry is a geometry having a square cross-section.

6. A linear actuator as set forth in claim 1, wherein the attachment member has a lower threaded portion which is screwed into a radial threaded opening in the piston-rod assembly.

7. A linear actuator as set forth in claim 6, wherein the rod includes the radial threaded opening, and wherein the lower portion of the attachment member is screwed into the radial threaded opening in the rod.

8. A linear actuator as set forth in claim 1, wherein the bearing block is removably attached to the piston-rod assembly.

9. A linear actuator as set forth in claim 8, wherein the bearing block linearly moves within the guide during movement of the piston-rod assembly.

10. A linear actuator as set forth in claim 1, further comprising a sensor assembly to generate signals when the piston-rod assembly is at certain positions and wherein the attachment member incorporates certain components of the sensor assembly.

11. A linear actuator as set forth in claim 1, wherein the guide slot axially offset from the internal bore.

12. A linear actuator as set forth in claim 1, wherein the guide and the bearing block are positioned a radial distance from the rod which is less than the diameter of the piston chamber.

13. A linear actuator as set forth in claim 1, wherein the housing defines an open-topped receptacle which is covered by a cover, wherein the guide constitutes a bottom extension of the receptacle, and wherein an upper portion the attachment member is positioned within the receptacle.

14. A method of inspecting and/or removing the bearing block of the linear actuator of claim 13, comprising the steps of:

uncovering the receptacle;

unscrewing the attachment member;

withdrawing the attachment member from the bearing block; and removing the bearing block from the guide.

15. A method of installing and/or re-installing the bearing block of the linear actuator of claim 13, comprising the steps of:

inserting the bearing block into the guide;

inserting the attachment member through the opening in the bearing block; and screwing the attachment member to the piston-rod assembly.

16. A linear actuator, comprising:

a housing, wherein the housing defines an internal bore, the internal bore having a rear part forming a piston chamber;

a piston positioned within the piston chamber, the piston being connected to a rod, wherein the rod comprises a plurality of radial threaded openings positioned about a circumference thereof, and wherein the piston is operable to linearly translate within the internal bore in response to fluid pressure, therein linearly translating the rod;

a guide, wherein the guide is defined by the housing, and wherein the guide is separate from the piston chamber; and a bearing block removably coupled to the rod and operable to linearly translate therewith, wherein the bearing block radially extends from the rod into the guide, and wherein the bearing block has a polygonal geometry that slidingly mates to the guide, therein defining a bearing surface, therein preventing a rotation of the rod; and an attachment member having a threaded portion, wherein the attachment member extends through an opening in the bearing block into the rod, therein removably coupling the bearing block to the rod, and, wherein the threaded portion of the attachment member is operable to be screwed into any of the plurality of radial threaded openings.

17. The linear actuator of claim 16, wherein the rod comprises four radial threaded openings spaced 90° about the circumference of the rod.

18. The linear actuator of claim 16, wherein the bearing block has a rectangular cross-section when viewed radially from the rod.

19. The linear actuator of claim 18, wherein the bearing block has a square cross-section when viewed radially from the rod.

20. The linear actuator of claim 16, further comprising a sensor assembly, wherein the attachment member further comprises at least a portion of the sensor assembly, wherein the sensor assembly is operable to generate signals when the rod is at certain positions.

21. The linear actuator of claim 16, wherein the housing further generally defines an open-topped receptacle, wherein a bottom extension of the receptacle is generally defined by the guide.

22. The linear actuator of claim 21, further comprising a cover, wherein the cover is removably attached to the open-topped receptacle, therein selectably concealing the guide.

23. The linear actuator of claim 16, wherein the guide is parallel to, but axially offset from, the internal bore.

24. A linear actuator, comprising:

a housing, wherein the housing defines an internal bore, the internal bore having a rear part forming a piston chamber;

a piston positioned within the piston chamber, the piston being connected to a rod, wherein the rod comprises a primary cylindrical portion and an extension portion which are coaxial with one another, wherein the primary cylindrical portion generally resides within the internal bore, and wherein the extension portion generally resides external to the housing, wherein the extension portion further comprises one or more of pilot holes, flats, and threaded passages for securing a locating pin thereto, and wherein the piston is operable to linearly translate within the internal bore in response to fluid pressure, therein linearly translating the rod;

a guide, wherein the guide is defined by the housing, and wherein the guide is separate from the piston chamber; and a bearing block removably coupled to the rod and operable to linearly translate therewith, wherein the bearing block radially extends from the rod into the guide, and wherein the bearing block has a polygonal geometry that slidingly mates to the guide, therein defining a bearing surface, therein preventing a rotation of the rod.

25. A linear actuator comprising:

a housing which defines an internal bore having a rear part forming a piston chamber;

a piston-rod assembly which linearly moves within the internal bore in response to fluid pressure and which includes a piston positioned within the piston chamber and a rod connected to the piston, wherein the rod comprises a primary cylindrical portion and an extension portion which are coaxial with one another, wherein the primary cylindrical portion generally resides within the internal bore, and wherein the extension portion generally resides external to the housing, wherein the extension portion further comprises one or more of pilot holes, flats, and threaded passages for securing a locating pin thereto;

a guide defined by the housing;

a bearing block, wherein the bearing block extends radially from the rod into the guide, therein defining a bearing surface, wherein the bearing block has a geometry to prevent rotation of the piston-rod assembly, and wherein the bearing block and the guide are separate from the piston chamber; and an attachment member that extends through an opening in the bearing block, therein coupling the bearing block to the rod, wherein the bearing block is operable to move within the piston-rod assembly.

* * * * *